United States Patent [19]

Garrett

[11] 4,378,759

[45] Apr. 5, 1983

[54] ANIMAL RESTRAINING DEVICE

[76] Inventor: Ted L. Garrett, 5694 County Rd. 23, Fostoria, Ohio 44830

[21] Appl. No.: 279,679

[22] Filed: Jul. 2, 1981

[51] Int. Cl.[3] ..... A61D 3/00

[52] U.S. Cl. ..... 119/98; 119/103

[58] Field of Search ..... 119/103, 98, 96; 17/44 R, 44.1

[56] References Cited

U.S. PATENT DOCUMENTS

| | | | |
|---|---|---|---|
| 69,195 | 9/1867 | Ellyson | 119/103 |
| 439,052 | 10/1890 | Copp | 119/103 |
| 2,630,099 | 3/1953 | Voigt | 119/103 |
| 2,929,357 | 3/1960 | Hoyme et al. | 119/98 |
| 3,530,834 | 9/1970 | Hollenback | 119/96 |
| 3,615,088 | 10/1971 | Compton | 119/103 |
| 4,223,639 | 9/1980 | Korkowski | 119/98 |

*Primary Examiner*—Jay N. Eskovitz
*Attorney, Agent, or Firm*—George R. Royer

[57] ABSTRACT

A portable device for restraining a four-legged animal for purposes of administering medical or other physical treatment that requires the animal to be held against moving its legs or making other bodily movements during such procedures; such device comprises in part a plate member against the one surface of which the back of the animal is placed. Mounted on the backing plate are restraining stirrups on the upper portion thereof into which stirrups the animal's rear or front legs are placed, with such legs locked thereto by a retractable locking mechanism. The holding plate on the device is affixed on the bottom thereof to a vertical stanchion which can be positioned on a fence post or other vertical post for holding the device in a substantially upright position.

2 Claims, 5 Drawing Figures

ANIMAL RESTRAINING DEVICE

BACKGROUND OF INVENTION

The subject invention pertains to a category of devices used to hold and restrain animals or parts of animals during the administration of medical and other similar physical treatment. Devices of this category are generally utilized to facilitate the treatment of animals in the medical process, and generally prevent jerking or squirming movements of the animal in order to prevent harm to the animal in the procedure.

Furthermore, the device herein is used specifically in those circumstances wherein the animal needs to be temporarily suspended or held by its legs to be able to administer treatment of one type or another to the animal's abdomen or back area. By holding the animal's legs, any jerking movements are substantially prevented.

All known devices in the prior art relating to devices of this type generally are either too cumbersome to transport from one location to another or are extremely restrictive so as to cause potential harm to the animal. Thus, there is a need for a device which effectively holds the animal in a manner whereby it will not be harmed by its movements during any potential physical treatment. The subject device is directed to improvements in this latter area and the following objects of the invention are directed to this end.

OBJECTS

It is an object of the subject invention to provide an improved device for securing and holding animals for administration of various types of medical or physical treatment;

A further object of the subject invention is to provide an improved mechanism for aiding in animal restraint for various medical or other related treatment procedure.

Yet another object of the subject invention is to provide a novel animal restraining device;

Still another object of the subject invention is to provide a device for safely securing and restraining animals while various types of physical treatment are administered to the animal;

Still another object of the subject invention is to provide a novel device for restraint of animals;

Another object of the subject invention is to provide a device for protecting animals during administration of any medical treatment;

Yet another object of the subject invention is to yield a humane methodology for treatment of animals;

A further object of the subject invention is to provide a device for holding animals in a relatively immovable position whenever physical treatment has to be administered to such animal.

Other and further objects of the subject invention will become apparent from a reading of the following description taken in conjunction with the drawings as set forth below.

DRAWINGS

DESCRIPTION OF GENERAL EMBODIMENT

The subject invention is a portable device for restraining animals for purposes of administering physical or other surgical treatment to the animal. Generally, the subject device is adapted to restrain either the front or rear legs of the animal so that it cannot move during the process.

The invention comprises several mutually cooperating elements. In general, there is a flat plate member adapted to be disposed in a substantially upright position, slightly tilted backwards, with the animal's back to be disposed against such plate. The plate has integrally affixed on the lower portion thereof a downwardly protruding hollow cylindrical member. The hollow open-ended portion of such cylindrical member extends downwardly and is adapted to fit over a post or other upwardly extending object so as to support the flat plate member vertically upward, as indicated.

Integrally disposed in the front upper surface of the plate member are a pair of leg restraint members which are adapted to receive portions of the animal's hind or front legs, as the situation dictates. The leg restraint devices are equipped with strap members which are adapted to be pulled inwardly and locked to secure the animal's legs firmly onto the device.

THE PREFERRED EMBODIMENT

In describing the preferred embodiment of the subject invention, the following nomenclaure will be used, among other words. First, the word "upper" will be used in relation to those parts of the subject device that are on the top of the device as it is disposed in its normally upright position. The word "lower" will be used in reference to all parts of the subject invention which are on the lower part of the device in its upright position. The word "front" will refer to that portion of the plate of the device upon which the animal is disposed, while the word "back" will be used in reference to positions posterior to the front on the plate. The words "longitudinal central axis" will be used in reference to the axis which extends longitudinally and symmetrical through the longest extent of the subject. The words "transverse axis" will be used in reference to axes or planes which are perpendicular to the longitudinal axis.

Figure 1:
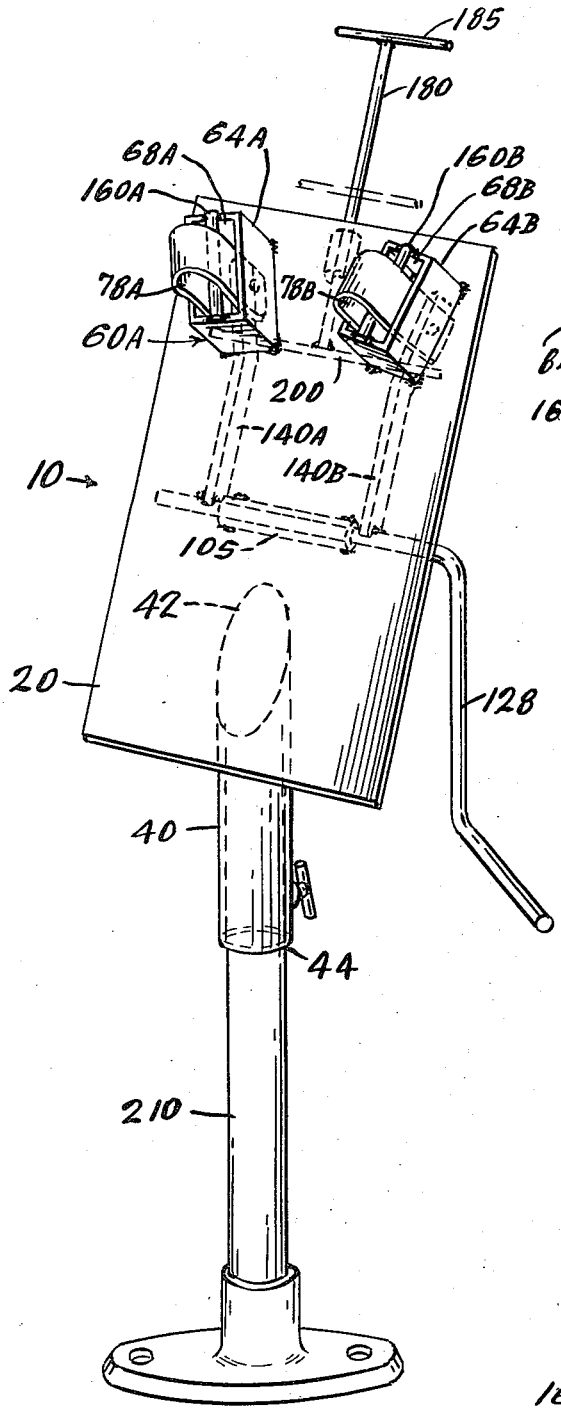
FIG. 1 is a perspective view of the subject invention.
Figure 2:
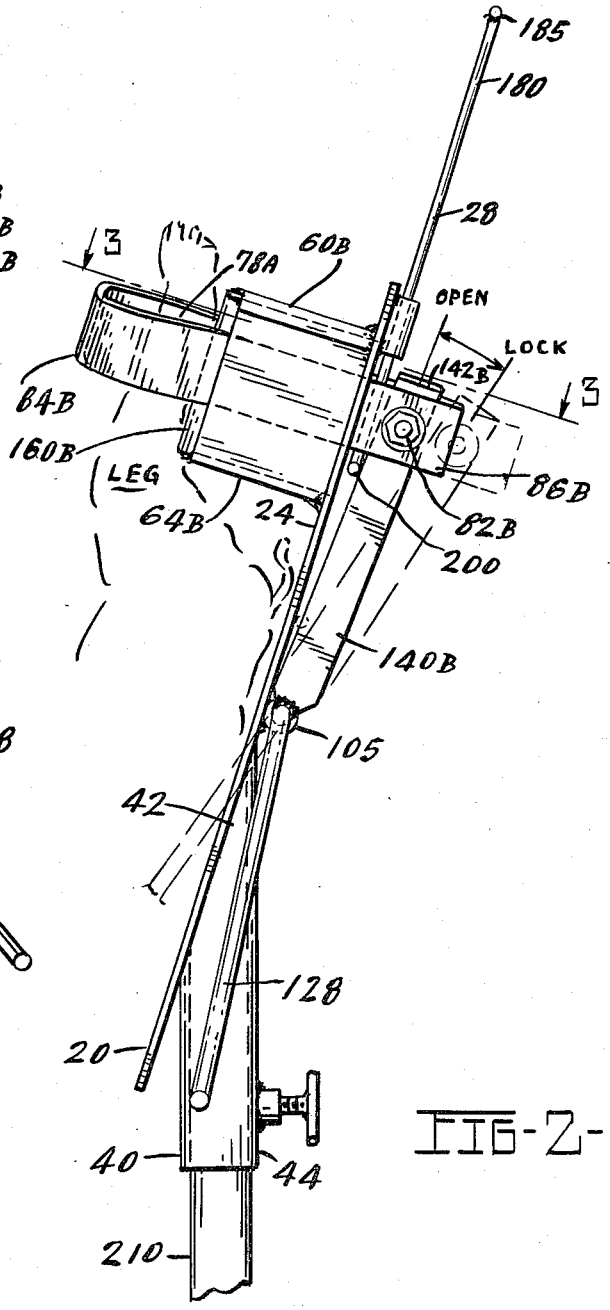
FIG. 2 is a side elevational view of the subject invention.

Referring now to the drawings in which a preferred embodiment is shown, and particularly to FIGS. 1 and 2, an animal restraining device 10 embodying the subject invention is such. Such device 10 includes a flat, rectangularly shaped support plate 20, adapted to be disposed in a substantially vertical, but slightly tilted position, towards the back, as particularly shown in FIGS. 1 and 2. This support plate 20, however, need not be precisely structured in a rectangular shape, as any shape will suffice so long as there is sufficient area thereon upon which the animal can be disposed frontally or posteriorly.

As shown in the drawings, the support plate member 20 has a frontal face 24 and a rear face 28. Mounted integrally to the lower rear face of the plate member 20 is a hollow cylindrical shaped and longitudinally extending post member 40, shown in FIGS. 1, 2 and 4.

Such cylindrical post member has an upper end 42 and a lower end 44, with the upper end being sliced by an oblique cut, as represented in FIG. 2. The oblique upper end 12 of post member 40 is welded to the lower back side of the holding plate member 20, such that the most upper distal portion of the upper end 42 of post member 40 is affixed pointing towards the upper part of the back side 28 of the holding plate 20, as shown in FIGS. 1 and 2. By such latter positioning, the cylindrical post member 40 projects obliquely and downwardly from the back lower side of the holding plate at an angle of approximately fifteen degrees, as represented in FIG. 2. However, this angular disposition is not considered critical, as any suitable angular arrangement can be used so long as the post member 40 holds the support plate 20 substantially upright.

Figure 5:
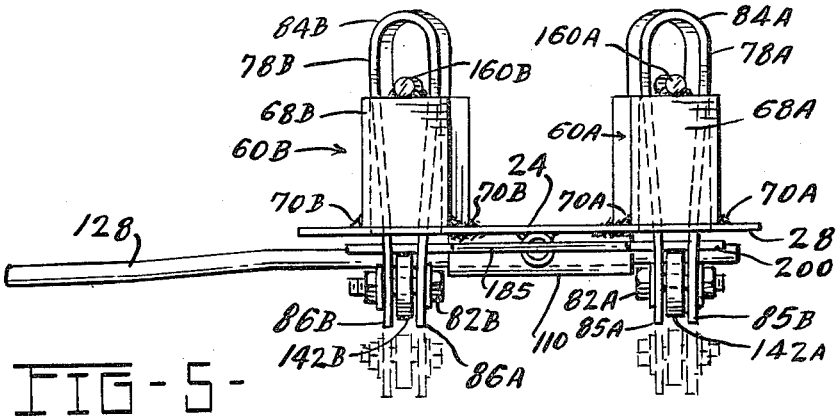
FIG. 5 is a top elevational view of the subject invention.

Integrally disposed in the upper frontal surface of the holding plate 20 are a pair of stirrup members 60A and 60B which are adapted to hold securely the rear or front legs of the animal, as the situation dictates. In this particular respect, shown in FIG. 2, is the phantom outline of an animal, showing how the hind legs of the animal are held in the stirrups 60A and 60B. These stirrup members are comprised of two parallelopiped shaped housing members 64A and 64B which are hollow with the hollow interior cavities 68A and 68B of such housings respectively extending from the front part of the housing back through correspondingly rectangularly shaped openings 65A and 65B respectively in the back 28 of the holding plate 20, as shown in the drawings. More specifically, as shown in FIGS. 2 and 5, the stirrups 60A and 60B are structured within hollow parallelopiped housings 64A and 64B. The latter housings with their respective rectangularly shaped hollow interiors 68A and 68B are integrally affixed to the upper front face 24 of support plate 20, as shown, with the rear rectangular openings 70A and 70B of such housings 64A and 64B juxtaposed congruently over corresponding rectangularly shaped openings through the support plate 20. As a result of the latter structural arrangement, the hollow interiors 68A and 68B of the respective housings 64A and 64B, extend all the way through to the back 28 of the plate 20.

Disposed longitudinally through such hollow interiors 68A and 68B respectively of housings 64A and 64B, are U-shaped strap members 78A and 78B respectively, each such strap member being preferably of a composition that will not cause harm to the animal's legs. The rear portions 85A and 85B and 86A and 86B respectively of the straps 78A and 78B are joined together by bolt means 82A and 82B respectively, as particularly shown in FIG. 5, rendering such straps closed members, with the front looped section 84A and 84B of such straps projecting a distance beyond the front part of housing 64A and 64B, as shown in FIGS. 2 and 5.

Figure 4:
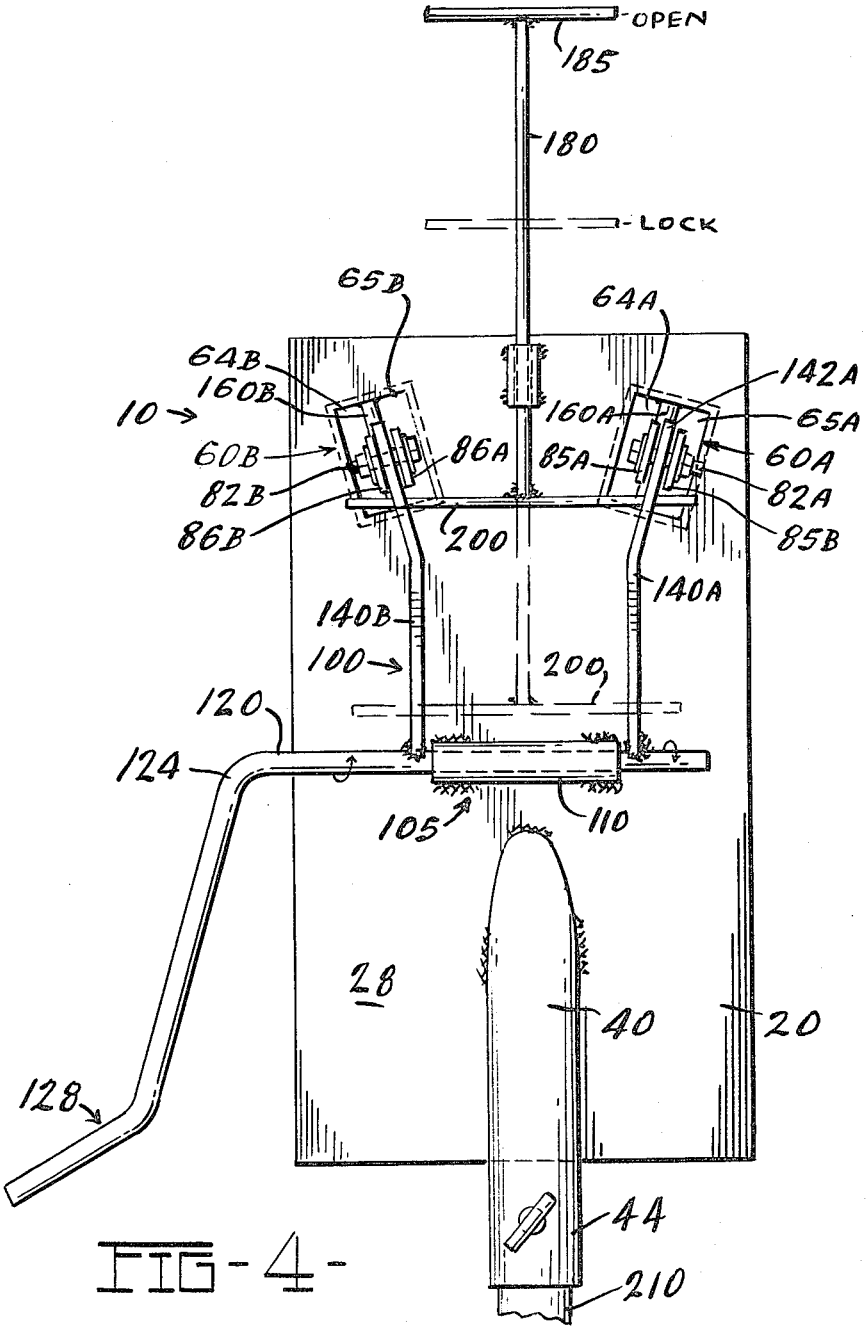
FIG. 4 is a rear elevational view of the subject invention.

Integrally appended to the rear face 28 of the support plate 20 is a strap tightening mechanism 100 which functions to draw the loops 84A and 84B of the straps 78A and 78B rearwardly into the hollow interior 68A and 68B of housings 60A and 60B so as to effectively tighten or close such loops towards the front openings of such housings with the animal's legs secured in such straps, as shown in phantom in FIG. 2. The strap-tightening mechanism comprises various elements as described below. First welded to the rear face 28 of support plate 28 is a cylindrical sleeve member 105, a portion of which is welded tangentially against the back face 28 of the plate 20, so that the hollow bore 110 of the sleeve 105 extends parallel to such back plate 28 as shown in FIGS. 4 and 5. Extending through such bore 110 is cylindrical actuating shaft 120, on the one end 124 of which is a rotatable and downwardly depending handle member 128. As affixed to the back surface 28 of support plate 20, the actuating shaft 120 is rotatable within hollow bore 110 of the cylindrical member 105. Thus, when handle member 128 is moved clockwise or counterclockwise away from or toward rear 28 of face plate 20, the shaft 120 rotates freely in a corresponding clockwise or counterclockwise movement within bore 110 of cylindrical sleeve 105, as diagrammatically shown in FIG. 4.

Figure 3:
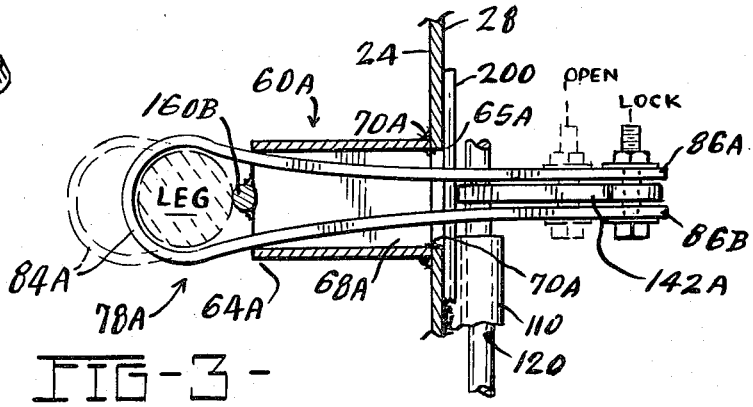
FIG. 3 is a top elevational view of the subject invention.

Welded to the upper peripheral surface of actuating shaft 120 are two upwardly, vertically extending rod members 140A and 140B, such members being mutually parallel. The upper ends 144A and 144B of such rod members 140 and 140B respectively are pivotally mounted respective to bolts 82A and 82B respectively as the rear portions part of straps 78A and 78B, as shown in FIG. 2. Thus, as can be seen, the upper ends 144A and 144B of such rods will move inwardly or outwardly depending on the respective clockwise or counterclockwise movement of the rod 120. Consequently, when the handle member 128 is moved counterclockwise the upper ends 144A and 144B of rod members 140A and 140B respectively are moved backwardly away from the rear face 28 of plate 20 causing the rods 140A and 140B to move to the position shown in phantom in FIG. 2. This backward movement of the upper ends 144A and 144B causes the straps 78A and 78B to move rearwardly and close loops 84A and 84B towards housings 64A and 64B, as shown, when the animal's legs are positioned in such loops. Therefore, as the straps 78A and 78B move rearwardly, the loop portions 84A and 84B pull rearwardly towards the internal chambers 68A and 68B respectively of the housings 64A and 64B. As such loops retract rearwardly towards the housings 64A and 64B, they essentially close or tighten, and whenever an animal's legs are place din such loops 84A and 84B, they are locked therein by the rearward movement of straps 78A and 78B by movement of handle member 120 as stated above. In FIG. 3, the straps 78A and 78B are shown in the retracted locked position, as described above.

Shown in FIG. 2, is a vertically drawn locking bar 180 with upper handle 185 and a lower perpendicular leg 188, which bar is slidably mounted in sleeve 190 mounted to the back face 28 of plate member 20 such sleeve being mounted in a vertical position. The bar 180 and lower leg 188 are movable to the lower inside or frontal part of bars 140A and 140B and serves to lock such vertical members 140A and 140B in the retracted backward position shown in FIG. 3.

Also, shown in FIG. 2 is a locking mechanism 200, structured to lock the vertical support member 44 to a post 210 or similar object. In this latter respect, whenever the vertical support member 44 is positioned on a post 210, the vertical support member 44 stands upright, allowing thereby the face plate 20 to be inclined slightly backwardly in the position shown in FIG. 2 of the drawings. This latter position serves as the working position.

As shown in FIG. 1, longitudinally pins 160 and 160B are integrally affixed to the upper and lower sides of the front portions of housings 64A and 64B. These pins 160A and 160B serve to keep the animal's legs from becoming drawn into the housings and thereby prevent injury whenever the legs are secured, as stated.

While a preferred embodiment of the subject invention is shown, it is not to be considered as limiting the scope of the subject invention.

I claim:

1. A device for holding an animal's legs securely in position for purposes of administering medical treatment to such animal, said device comprising:

(a) a support plate member, said support plate member having a front face an back face, said support plate member being adapted to be supported in a substantially upright position, and said support plate member having two openings in a portion of said plate, each of which opening extend completely from the front face to the back face of said support plate member;

(b) a frame member affixed over each of said openings in said support plate with said frame members having a hollow interior extending completely through the frame member with two openings on each end of each frame member such that one opening of such frame member is in position directly over its adjacent opening and the other opening being directed outwardly away from the front face of the plate;

(c) loop means affixed through the hollow interior of the frame members and through the openings in said plate with the loop portion extending out through the opening in the frame into the area outwardly of the plate.

2. A device for holding an animal's legs securely in position for purposes of administering medical treatment to such animal, said device comprising:

(a) a support plate member, said support plate member having a front face and back face, said support plate member being adapted to be supported in a substantially upright position, and said support plate member having two openings in a portion of said plate, each of which opening extend completely from the front face to the back face of said support plate member;

(b) a frame member affixed over each of said openings in said support plate with said frame members having a hollow interior extending completely through the frame member with two openings on each end of each frame member such that one opening of such frame member is in position directly over its adjacent opening and the other opening being directed outwardly away from the front face of the plate;

(c) loop means affixed through the hollow interior of the frame members and through the openings in said plate with the loop portion extending out through the opening in the frame into the area outwardly of the plate;

(d) portable locking means disposed on the rear face of said support plate member to lock said loops into position.

* * * * *